US011871877B2

(12) United States Patent
Larsson et al.

(10) Patent No.: US 11,871,877 B2
(45) Date of Patent: Jan. 16, 2024

(54) SEPARATION UNIT AND A DISPENSER COMPRISING A SEPARATION UNIT

(71) Applicant: Essity Hygiene and Health Aktiebolag, Gothenburg (SE)

(72) Inventors: Björn Larsson, Billdal (SE); Per Moller, Borlange (SE); Lars Thoren, Borlange (SE); Jari Haukirauma, Borlange (SE); Stig Pommer, Borlange (SE); Joonas Jokitalo

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 49 days.

(21) Appl. No.: 16/793,199

(22) Filed: Feb. 18, 2020

(65) Prior Publication Data

US 2020/0383530 A1 Dec. 10, 2020

Related U.S. Application Data

(63) Continuation of application No. 15/964,934, filed on Apr. 27, 2018, now Pat. No. 10,568,471, which is a (Continued)

(51) Int. Cl.
*A47K 10/36* (2006.01)
*A47K 10/44* (2006.01)

(Continued)

(52) U.S. Cl.
CPC ..... *A47K 10/36* (2013.01); *A47K 10/3643* (2013.01); *A47K 10/38* (2013.01);

(Continued)

(58) Field of Classification Search
CPC .... A47K 10/36; A47K 10/3643; A47K 10/38; A47K 10/44; A47K 10/16;

(Continued)

(56) References Cited

U.S. PATENT DOCUMENTS 400,913 A * 4/1889 Hicks ..... A47K 10/3643 283/105
511,983 A * 1/1894 Wheeler ..... A47K 10/32 206/394

(Continued)

FOREIGN PATENT DOCUMENTS

CA 2035651 A * 8/1992 ..... A47K 10/36
CN 2085219 U 9/1991

(Continued)

OTHER PUBLICATIONS

International Search Report (PCT/ISA/210) dated Dec. 18, 2014, by the Swedish Patent Office as the International Searching Authority for International Application No. PCT/SE2014/050518.

(Continued)

*Primary Examiner* — Rakesh Kumar
(74) *Attorney, Agent, or Firm* — BUCHANAN INGERSOLL & ROONEY PC

(57) ABSTRACT

A separation unit for separating a web material along preformed lines of weakness. The separation unit has a width direction and includes a first roller having a rotational axis extending in the width direction and a web width extending in the width direction, and a second roller having a rotational axis extending parallel with the rotational axis of the first roller and a web width extending in the width direction. The second roller is positioned at a distance from the first roller. Each of the first and the second rollers is provided with a plurality of protrusion elements being spaced along the rotational axes and protruding perpendicular from the axes. Each of the protrusion elements has a maximum width in the width direction, a maximum radial extension from the rotational axes, an inner portion adjacent to the rotational axes, and an outer portion remote from the rotational axes.

17 Claims, 6 Drawing Sheets

Related U.S. Application Data continuation of application No. 14/438,442, filed as application No. PCT/SE2012/051160 on Oct. 26, 2012, now Pat. No. 9,999,325.

(51) Int. Cl.

| | |
|---|---|
| ***B65H 35/10*** | (2006.01) |
| ***A47K 10/38*** | (2006.01) |
| ***A47K 10/42*** | (2006.01) |
| ***A47K 10/16*** | (2006.01) |

(52) U.S. Cl.

CPC ..... *A47K 10/44* (2013.01); *B65H 35/10* (2013.01); *A47K 10/16* (2013.01); *A47K 10/3612* (2013.01); *A47K 10/426* (2013.01); *A47K 2010/3881* (2013.01)

(58) Field of Classification Search

CPC ..... A47K 10/3612; A47K 10/426; A47K 2010/3881; B65H 35/10

USPC ... 221/26, 119, 121, 120, 167, 122, 43, 259, 221/277; 492/30, 38, 34

See application file for complete search history.

(56) References Cited

U.S. PATENT DOCUMENTS 804,306 A 11/1905 Fonda
804,307 A 11/1905 Fonda
1,658,608 A 2/1928 Marcuse
1,780,275 A * 11/1930 Randerson ..... A47K 10/16 428/43
2,347,823 A 5/1944 Gootman et al.
2,809,082 A * 10/1957 Marcuse ..... A47K 10/34 226/186
2,886,226 A 5/1959 Batlas et al.
2,974,839 A 3/1961 Batlas et al.
3,276,636 A * 10/1966 Johnson, Jr. ..... B65D 83/0409 221/266
3,653,539 A 4/1972 Stageberg
3,770,172 A 11/1973 Nystrand et al.
3,826,548 A 7/1974 Schnyder et al.
3,877,576 A * 4/1975 Kishi ..... A47K 10/16 206/412
3,991,998 A 11/1976 Banz et al.
4,089,378 A 5/1978 Suzuki et al.
4,106,684 A * 8/1978 Hartbauer ..... A47K 10/3637 226/110
4,148,442 A 4/1979 Baumann et al.
4,276,797 A 7/1981 Baumann et al.
4,288,068 A 9/1981 Hashimoto et al.
4,358,169 A * 11/1982 Filipowicz ..... A47K 10/3637 225/8
4,494,747 A * 1/1985 Graef ..... B65H 7/12 221/21
4,505,381 A * 3/1985 Major ..... B65G 47/261 198/781.04
4,516,711 A 5/1985 Barege
4,614,632 A * 9/1986 Kezuka ..... B29C 51/22 425/363
4,677,283 A * 6/1987 Lewis ..... A61J 7/02 198/383
4,684,119 A 8/1987 Lane
4,697,656 A 10/1987 De
4,779,861 A * 10/1988 Ozawa ..... B65H 3/06 271/119
4,818,042 A 4/1989 Arabian et al.
4,861,013 A * 8/1989 Shibata ..... B65H 3/5261 271/119
5,033,620 A * 7/1991 De Luca ..... A47K 10/34 206/460
5,061,232 A * 10/1991 Bloch ..... A47K 10/34 493/395
5,092,573 A 3/1992 Abreu
5,098,078 A * 3/1992 Nakanishi ..... B65H 3/0653 271/265.04
5,152,522 A * 10/1992 Yamashita ..... B65H 27/00 226/185
5,190,514 A 3/1993 Galvanauskas
5,203,846 A 4/1993 Kuhns et al.
5,205,454 A 4/1993 Schutz et al.
5,265,509 A 11/1993 Chen
5,317,645 A * 5/1994 Perozek ..... G06M 11/00 382/141
5,372,359 A * 12/1994 Miura ..... B65H 3/0638 271/119
5,375,785 A * 12/1994 Boone ..... A47K 10/3656 242/560.1
5,463,839 A * 11/1995 Stange ..... B65B 5/103 53/504
5,518,144 A 5/1996 Samuelson et al.
5,638,417 A * 6/1997 Boyer ..... B65B 37/04 377/6
5,653,439 A 8/1997 Rider et al.
5,671,262 A * 9/1997 Boyer ..... G06M 1/101 377/6
5,860,563 A * 1/1999 Guerra ..... G07F 9/002 221/172
5,868,275 A 2/1999 Moody
5,882,004 A * 3/1999 Padget ..... B65H 3/0638 271/902
5,924,687 A 7/1999 Hannon
5,975,518 A * 11/1999 Wakana ..... B65H 3/0661 271/121
6,053,302 A * 4/2000 Leu ..... G06M 11/00 198/803.5
6,070,867 A * 6/2000 Tsurumi ..... B65H 3/0669 271/157
6,186,490 B1 * 2/2001 Sugiura ..... B65H 3/0638 271/120
6,213,346 B1 4/2001 Skerrett et al.
6,311,819 B1 * 11/2001 Stromme ..... G07D 7/003 194/207
6,378,858 B1 * 4/2002 Suga ..... B65H 3/5261 271/10.01
6,447,864 B2 * 9/2002 Johnson ..... A47K 10/16 221/33
6,510,962 B1 * 1/2003 Lim ..... G07F 17/0014 700/243
6,520,408 B1 * 2/2003 Force ..... G07F 19/201 235/379
6,536,624 B2 3/2003 Johnson et al.
6,609,449 B2 * 8/2003 Granger ..... A47K 10/3643 74/32
6,655,679 B2 * 12/2003 Boucher ..... B65H 5/068 271/9.01
6,736,466 B1 5/2004 Helland et al.
6,860,447 B2 3/2005 Boone et al.
6,971,542 B2 12/2005 Vogel et al.
7,144,006 B2 * 12/2006 Graef ..... B65H 3/5207 271/119
7,149,600 B2 * 12/2006 Rippolone ..... G06Q 10/087 221/12
7,182,329 B2 2/2007 Graef et al.
7,191,657 B2 * 3/2007 Maier ..... G07D 7/20 73/159
7,195,237 B2 3/2007 Graef et al.
7,344,132 B2 3/2008 Graef et al.
7,472,802 B2 1/2009 van Riel
7,878,445 B2 2/2011 Granger et al.
7,922,167 B2 * 4/2011 Kajiyama ..... B65H 5/36 271/4.01
7,954,405 B2 6/2011 Kling
8,083,078 B2 * 12/2011 Omura ..... G07F 11/38 211/59.3
8,108,068 B1 * 1/2012 Boucher ..... G01G 17/00 700/240
8,225,925 B2 * 7/2012 Bassani ..... B65G 47/26 198/758

(56) References Cited

U.S. PATENT DOCUMENTS 8,298,640 B2 * 10/2012 Cattacin ..... B65H 45/142 428/43
8,356,767 B2 1/2013 Formon et al.
8,712,268 B2 * 4/2014 Iwasaki ..... G03G 15/2064 399/329
8,741,410 B2 * 6/2014 Cattacin ..... B65H 33/18 428/43
8,899,508 B2 12/2014 Hjort et al.
8,910,941 B2 12/2014 Jacobs
9,078,546 B2 7/2015 Kaufmann
9,492,355 B2 * 11/2016 Ratnakar ..... G16H 20/13
9,542,534 B1 * 1/2017 Ducatt ..... G07F 9/002
9,572,460 B2 2/2017 Petocchei et al.
9,668,621 B2 6/2017 Andersson et al.
9,984,213 B2 * 5/2018 Howieson ..... A61J 1/03
9,999,325 B2 6/2018 Larsson et al.
10,390,664 B2 8/2019 Larsson et al.
10,568,471 B2 2/2020 Larsson et al.
2001/0020626 A1 9/2001 Skerrett et al.
2002/0033405 A1 3/2002 Gergek et al.
2003/0024943 A1 * 2/2003 MacDonald ..... G07F 17/0092 221/92
2003/0110915 A1 6/2003 Kapiloff et al.
2003/0121970 A1 7/2003 Force et al.
2004/0041330 A1 * 3/2004 Ko ..... B65H 3/0607 271/121
2004/0256516 A1 12/2004 Granger
2005/0067519 A1 * 3/2005 King ..... B65H 35/0006 242/526.1
2005/0223860 A1 10/2005 Formon
2005/0275153 A1 * 12/2005 Owa ..... A47K 10/36 271/121
2006/0006190 A1 * 1/2006 Janet ..... G07F 17/0092 221/211
2006/0065094 A1 3/2006 Lewis et al.
2006/0071011 A1 * 4/2006 Varvarelis ..... A61J 7/0481 221/9
2007/0010389 A1 1/2007 Cutrona et al.
2007/0034534 A1 2/2007 Vanburen
2007/0089582 A1 4/2007 Formon
2007/0145062 A1 6/2007 Formon et al.
2007/0236110 A1 10/2007 Kling
2008/0023905 A1 1/2008 Graef et al.
2008/0121649 A1 5/2008 Kistner
2009/0014945 A1 * 1/2009 Izumichi ..... B65H 3/5261 271/119
2009/0046136 A1 2/2009 Choi et al.
2009/0057478 A1 3/2009 Conner
2009/0218363 A1 * 9/2009 Terzini ..... B65B 5/103 221/4
2009/0321470 A1 * 12/2009 Knoth ..... B65B 5/103 221/7
2010/0025519 A1 2/2010 Granger et al.
2010/0046994 A1 2/2010 Kikuchi et al.
2010/0068092 A1 3/2010 Larsson
2010/0258579 A1 10/2010 Billman et al.
2011/0088810 A1 * 4/2011 Cicognani ..... B65B 35/14 141/192
2011/0089213 A1 4/2011 Granger
2011/0101020 A1 * 5/2011 Granger ..... A47K 10/424 221/45
2011/0139920 A1 * 6/2011 Formon ..... A47K 10/3836 242/559.2
2011/0210137 A1 9/2011 Kling
2012/0072017 A1 * 3/2012 Kim ..... B65B 57/20 700/231
2012/0085777 A1 4/2012 Bucci et al.
2012/0193463 A1 8/2012 Newhouse et al.
2012/0211509 A1 * 8/2012 Granger ..... A47K 10/32 242/570
2013/0099924 A1 4/2013 Larsson et al.
2013/0105614 A1 5/2013 Hjort et al.
2013/0161346 A1 6/2013 Wolme et al.
2013/0270290 A1 10/2013 Schmidt et al.
2013/0277492 A1 10/2013 Granger et al.
2014/0138398 A1 * 5/2014 Daniels ..... B65D 83/04 221/202
2014/0209624 A1 7/2014 Larsson
2014/0353327 A1 * 12/2014 Bae ..... G07F 17/0092 221/12
2014/0358278 A1 * 12/2014 Zhang ..... G16H 20/13 700/240
2015/0077449 A1 3/2015 Kobashi
2015/0102048 A1 4/2015 Case et al.
2015/0150423 A1 6/2015 Pommer et al.
2015/0175287 A1 * 6/2015 Tidhar ..... B65B 5/103 700/240
2015/0282678 A1 10/2015 Larsson et al.
2015/0282679 A1 * 10/2015 Larsson ..... A47K 10/3643 221/26
2015/0282680 A1 10/2015 Larsson et al.
2015/0297042 A1 10/2015 Larsson et al.
2016/0247345 A1 * 8/2016 Ratnakar ..... G16H 70/40
2018/0242797 A1 8/2018 Larsson et al.

FOREIGN PATENT DOCUMENTS

CN 2527209 Y 12/2002
CN 1600210 A 3/2005
CN 1625364 A 6/2005
CN 1937946 A 3/2007
CN 101026986 A 8/2007
CN 101080188 A 11/2007
CN 101351290 A 1/2009
CN 102281808 A 12/2011
CN 102395307 A 3/2012
CN 202173351 U 3/2012
CN 102762137 A 10/2012
CN 102905593 A 1/2013
CN 102984979 A 3/2013
CN 103607934 A * 2/2014 ..... A47K 10/424
CN 103648936 A 3/2014
CN 104188587 A * 12/2014 ..... A47K 10/36
CN 104363807 A 2/2015
EP 0154497 A2 9/1985
EP 0236709 A1 9/1987
EP 0392696 A1 10/1990
EP 1830687 B1 5/2010
EP 2975233 A1 * 1/2016 ..... B01D 53/9431
FR 853284 A 3/1940
FR 2539726 A2 7/1984
FR 2932671 A1 * 12/2009 ..... A47K 10/424
GB 2433248 A 6/2007
JP 2001247257 A 9/2001
JP 2002065500 A 3/2002
JP 2011194125 A 10/2011
RU 2688358 C1 * 5/2019 ..... A47K 10/16
WO 2004056250 A1 7/2004
WO 2006071148 A1 7/2006
WO WO-2006071148 A1 * 7/2006 ..... A47K 10/36
WO 2007000153 A1 1/2007
WO 2008009760 A2 1/2008
WO 2008078168 A2 7/2008
WO 2011045493 A1 4/2011
WO 2011149393 A1 12/2011
WO WO-2011149393 A1 * 12/2011 ..... A47K 10/36
WO 2012003867 A1 1/2012
WO WO-2012003867 A1 * 1/2012 ..... A47K 10/36
WO 2012076776 A1 6/2012
WO 2012/134362 A1 10/2012
WO 2013007302 A2 1/2013
WO 2013115687 A1 8/2013
WO 2013184049 A1 12/2013
WO WO-2013184049 A1 * 12/2013 ..... A47K 10/3818
WO WO-2020126048 A1 * 6/2020 ..... A47K 10/16

OTHER PUBLICATIONS

Office Action (Examination report No. 1 for Standard Patent Application) dated Oct. 20, 2017, by the Australian Patent Office in

(56) References Cited

OTHER PUBLICATIONS corresponding Australian Patent Application No. 2014392814. (4 pages).
Office Action dated Mar. 20, 2018, by the Federal Service for Intellectual Property in Russian Patent Application No. 2016146116/12(074014) and an English Translation of the Office Action. (14 pages).
Office Action dated May 17, 2019, by the Australian Government/IP Australia in corresponding Australian Patent Application No. 2018260790. (4 pages).
Office Action No. 12168, dated Nov. 14, 2018, by the Colombian Patent Office in Colombian Patent Application No. NC2018/0009220 and Agents Letter in English Language, (11 pages).
Office Action No. 12173, dated Nov. 8, 2018, by the Colombian Patent Office in Colombian Patent Application No. NC2017/0002817 and Agents Letter in English Language, (15 pages).
Office Action dated Jun. 30, 2018, by the Colombian Patent Office in corresponding Colombian Patent Application No. NC2017/0002817. (19 pages).
Second Examination Report dated Apr. 9, 2018 by the Australian Patent Office in Australian Patent Application 2014392814, 4 pages.
The extended European Search Report dated Nov. 6, 2017, by the European Patent Office in corresponding European Patent Application No. 14890725.6-1601. (12 pages).
Written Opinion of the International Preliminary Examining Authority (PCT Rule 66) (Form PCT/IPEA/408) dated May 17, 2016, by the European Patent Office as the International Searching Authority for International Application No. PCT/SE2014/050518.
Written Opinion of the International Searching Authority (PCT/ISA/237) dated Dec. 18, 2014, by the Swedish Patent Office as the International Searching Authority for International Application No. PCT/SE2014/050518.
Notification of Transmittal of The International Preliminary Report on Patentability (Form PCT/IPEA/416) and International Preliminary Report on Patentability (Form PCT/IPEA/409) dated Jul. 20, 2016, by the European Patent Office for International Application No. PCT/SE2014/050518.
Office Action (Notification of the First Office Action) dated Sep. 14, 2018 by the State Intellectual Property Office of the People's Republic of China in corresponding Chinese Patent Application No. 201480079420.0, and an English Translation of the Office Action. (16 pages).
Office Action (Notification of the Second Office Action) dated May 20, 2020 by the State Intellectual Property Office (SIPO) of the People's Republic of China in corresponding Chinese Patent Application No. 201480079420.1, and an English Translation of the Office Action. (13 pages).
Extended European Search Report in corresponding European Application No. 20194912.2-1005, dated May 12, 2021 (9 pages).
An English Translation of the Office Action (Decision on Grant) dated Apr. 28, 2016, by the Federal Service for Intellectual Property Office in Russian Patent Application No. 2015119664/12. (6 pages).
English language translation of Office Action/Search Report dated May 17, 2016, by the Russian Patent Office in corresponding Russian Patent Application No. 2015119242. (9 pages).
Office Action (Text of the First Office Action) dated Nov. 22, 2019, by the State Intellectual Property Office (SIPO) of the People's Republic of China in corresponding Chinese Patent Application No. 201711308320.3 (31 pages).
European Patent Office dated Aug. 22, 2014. (4 pages).
PCT1SE2012105116, "International Preliminary Report on Patentability Received", 7 pages.
Office Action (Notification of the Fourth Office Action) dated Sep. 30, 2020, by the China National Intellectual Property Administration (CNIPA) of the People's Republic of China in corresponding Chinese Patent Application No. 201480079420.1 and an English Translation of the Office Action. (15 pages).
Office Action (Note No. 11541) dated Sep. 15, 2020, by the Industry and Commerce in corresponding Colombian Patent Application No. NO2020/0008801, and an English Translation of the Office Action. (22 pages).
Office Action (Notification of the 2nd Office Action) dated Jun. 24, 2020, by the National Intellectual Property Administration (CNIPA) of the People's Republic of China in corresponding Chinese Patent Application No. 201711308320.3, and an English Translation of the Office Action. (20 pages).
International Search Report (PCT/ISA/210) dated Jul. 1, 2013, by the Swedish Patent Office as the International Searching Authority for International Application No. PCT/SE2012/051158.
Written Opinion (PCT/ISA/237) dated Jul. 1, 2013, by the Swedish Patent Office as the International Searching Authority for International Application No. PCT/SE2012/051158.
International Preliminary Report on Patentability (PCT/IPEA/409) dated Jan. 29, 2015, by the Swedish Patent Office as the International Preliminary Examining Authority for International Application No. PCT/SE2012/051158.
Written Opinion of the International Preliminary Examining Authority (PCT/IPEA/408) dated Nov. 10, 2014, by the Swedish Patent Office as the International Preliminary Examining Authority for International Application No. PCT/SE2012/051158.
PCT Demand (PCT/IPEA/401) dated Mar. 11, 2014, by the Swedish Patent Office as the International Preliminary Examining Authority for International Application No. PCT/SE2012/051158.
International Search Report (PCT/ISA/210) dated Dec. 2, 2013, by the Swedish Patent Office as the International Searching Authority for International Application No. PCT/SE2013/050204.
Written Opinion (PCT/ISA/237) dated Dec. 2, 2013, by the Swedish Patent Office as the International Searching Authority for International Application No. PCT/SE2013/050204.
International Preliminary Report on Patentability (PCT/IPEA/409) dated Mar. 31, 2014, by the Swedish Patent Office as the International Preliminary Examining Authority for International Application No. PCT/SE2013/050204.
PCT Demand (PCT/IPEA/401) dated Mar. 31, 2014, by the Swedish Patent Office as the International Preliminary Examining Authority for International Application No. PCT/SE2013/050204.
International Search Report (PCT/ISA/210) dated Jul. 8, 2013, by the Swedish Patent Office as the International Searching Authority for International Application No. PCT/SE2012/051160.
Written Opinion (PCT/ISA/237) dated Jul. 8, 2013, by the Swedish Patent Office as the International Searching Authority for International Application No. PCT/SE2012/051160.
The extended European Search Report dated May 6, 2016, by the European Patent Office in corresponding European Patent Application No. 12887211.6-1601. (9 pages).
The extended European Search Report dated May 6, 2016, by the European Patent Office in European Patent Application No. 12887301.5-1601. (8 pages).
An English Translation of the Official Action/Search Report dated May 17, 2016, by the Federal Service for Intellectual Property Office in Russian Patent Application No. 2015119242/12. (9 pages).
The extended European Search Report dated Jun. 29, 2016, by the European Patent Office in European Patent Application No. 13848737.6-1601. (8 pages).
Office Action (Notification of the First Office Action) dated Sep. 19, 2016, by the state intellectual property office (SIPO) of the People's Republic of China in corresponding Chinese Patent Application No. 201280076556.8, and an English Translation of the Office Action. (5 pages).
Office Action (Notification of the First Office Action) dated Sep. 20, 2016, by the State Intellectual Property Office (SIPO) of the People's Republic of China in Chinese Patent Application No. 201280076596.2, and an English Translation of the Office Action. (19 pages).
The extended European Search Report dated Jun. 29, 2016, by the European Patent Office in European Patent Application No. 12886996.3-1601. (7 pages).
Notification of Transmittal of the International Preliminary Report on Patentability (Forms PCT/IPEA/416 and PCT/IPEA/409) dated

(56) References Cited

OTHER PUBLICATIONS

Jan. 16, 2015, by the European Patent Office in the International Application No. PCT/SE2012/051164. (7 pages).
Notification of Transmittal of the International Search Report and the Written Opinion of the International Searching Authority (Forms PCT/ISA/220, PCT/ISA/210 and PCT/ISA/237) dated Jun. 18, 2013, by the Swedish Patent Office in the International Application No. PCT/SE2012/051164. (12 pages).
Written Opinion of the International Preliminary Examining Authority (Form PCT/IPEA/408) dated Oct. 22, 2014, by the European Patent Office in the International Application No. PCT/SE2012/051164. (6 pages).
Office Action (Notification of the second Office Action) dated Apr. 10, 2017, by the State Intellectual Property Office (SIPO) of the People's Republic of China in Chinese Patent Application No. 201280076596.2, and an English Translation of the Office Action. (21 pages).
Office Action (Notification of the second Office Action) dated May 10, 2017, by the State Intellectual Property Office (SIPO) of the People's Republic of China in Chinese Patent Application No. 201280076557.2, and an English Translation of the Office Action. (20 pages).
Office Action (Communication pursuant to Article 94(3) EPC) dated Oct. 2, 2017, by the European Patent Office in the European Patent Application No. 12 887 301.5-1601. (5 pages).
Office Action (Notification of the third Office Action) dated Aug. 21, 2017, by the State Intellectual Property Office (SIPO) of the People's Republic of China in the Chinese Patent Application No. 201280076596.2, and an English Translation of the Office Action. (21 pages).
Office Action (Communication pursuant to Article 94(3) EPC) dated Sep. 4, 2017, by the European Patent Office in corresponding European Patent Application No. 12 887 211.6-1601. (5 pages).
Office Action (Non-Final) issued by the U.S. Patent and Trademark Office in the U.S. Appl. No. 15/307,313 dated Sep. 18, 2020, U.S. Patent and Trademark Office, Alexandria, VA. (14 pages).
Communication pursuant to Article 94(3) EPC issued in European Patent Application No. 20 194 812.2-1005, dated Jun. 9, 2023 (6 pages).

* cited by examiner

SEPARATION UNIT AND A DISPENSER COMPRISING A SEPARATION UNIT

CROSS REFERENCE TO RELATED APPLICATIONS

The present application is a continuation of U.S. application Ser. No. 15/964,934, filed on Apr. 27, 2018, which is a continuation of U.S. application Ser. No. 14/438,442, filed on Apr. 24, 2015, now U.S. Pat. No. 9,999,325, which is a U.S. national stage of International Application No. PCT/SE2012/051160, filed on Oct. 26, 2012. The entire contents of each of U.S. application Ser. No. 14/438,442 and International Application No. PCT/SE2012/051160 are hereby incorporated herein by reference in their entirety.

TECHNICAL FIELD

The present invention concerns a separation unit for separating a perforated web material such as paper towels, tissue paper or nonwoven material along the perforation lines.

The present invention further relates to a dispenser for a web material, comprising a housing defining a web material reservoir, a dispensing opening, a control unit, and said separation unit.

BACKGROUND

Automatic touchfree dispensers (or "hands-free dispensers") for paper towels are known on the market. The hands-free dispensers are electronically maneuvered, they store and advance the paper towel with different kinds of control devices, sensors and power sources available. Without touching the dispenser, the user can get a paper towel that is fed automatically by the electronic dispenser. Dispensers like this are commonly used in public lavatories for dispensing paper towels to users. The most common type of a powered, hands-free dispenser is a roll dispenser that users sensors to initiate the mechanisms for advancing the towel such that the subsequent sheet is presented to the user.

Rolls of paper towels are often heavy and there is a friction and resistance for unrolling the paper. Especially when the roll is accelerated there is a high demand of energy. Consequently, there is a need for a strong paper in order to withstand the force necessary to make a full heavy roll to start rotating. A strong paper usually has drawbacks in that the softness of the paper is low. In addition, hands-free dispensers for rolled paper towels demand a large amount of space due to the relatively large volume of the heavy paper rolls.

As an alternative to rolls of paper towels, US2011/0101020, WO 2011/045493, EP 1 830 687 all disclose dispensing units comprising a housing for holding a pile of a continuous length of accordion-like folded web of towels. The dispenser comprises an access opening to the pile, a dispensing opening for the web of towels, a feeding mechanism comprising a member for controlling the dispensing of the web of towels, and a drive unit. Bundles of paper towels with connecting means there between are insertable through the access opening into the housing in the dispensing unit and may be added to the bottom of the pile. The web of towels is dispensable from the upper part of the pile by the feeding mechanism, which positions the web of towels in a starting mode in the dispensing opening. This solution enables feeding of a large amount of wipe products while avoiding the problems relating to the weight of a heavy paper roll or large pile. Preferably, the folded web material comprises a double folded perforated web material, where two perforated webs are interfolded, such that the perforations are arranged in an off-set relationship to each other. A separation unit enables the wipe products to be separated at the lines of weakness when the web is pulled by the user. This feature will allow the feeding of the products to be performed manually by the user, hence avoiding any additional arrangements of the dispensers such as electrical power.

However, to realize the dispenser as described above a number of problems must be solved, including separating the webs correctly along the perforation lines, feeding the next portion of the web to be separated to the separation unit, and presenting the leading end of the web to the next user. Furthermore, separation shall be possible for different types of web materials and web materials having different lengths between the perforation lines.

GB 2 433 248 describes a dispenser for feeding a rolled material comprising two perforated webs, wherein the perforations are in offset relationship. The dispenser comprises two profiled rollers being arranged to form a non-linear nip, applying pressure to the sheet material so that the lines of weakness of the web material would burst. The nip is formed by protrusion elements of different sizes arranged on two rollers. It is shown that the surfaces of each pair of opposing protrusion elements are always in contact with each other.

WO 2011/1149393 describes a dispenser for feeding a rolled tissue or nonwoven material, which may be provided with perforations. A problem with perforated webs is defined, relating to the fact that the web tends to break at every perforation, but that the user might sometimes wish to use a long section of web and sometimes a short section of web. For feeding the web in the dispenser, there is provided a drive roller and an engaging roller. The drive roller and the engaging roller are arranged such that an undulated passage is defined between the protrusion elements on the rollers. It is stated that the undulated passage ensures that the dispensing end of the web is in contact with both the drive roller and the engaging roller in the passage. Also, a pulling force exerted substantially straight out from the dispensing passage is distributed evenly over a central portion of the web, which results in that the web will not break even if perforated, until the user chooses to apply a force sideways. The separation is thus done by the user rather than by the dispenser itself.

It is therefore an object of the present invention to provide a separation unit eliminating the above-mentioned problems.

SUMMARY

According to the present invention, a separation unit for separating a web material along preformed lines of weakness is provided. The separation unit has a width direction and comprises a first roller having a rotational axis extending in the width direction and a web width extending in said width direction, and a second roller having a rotational axis extending parallel with the rotational axis of the first roller and a web width extending in said width direction. A web width of a roller is a portion of the roller extending along the width direction of the roller. Over the web width of the roller the web material is arranged to pass during dispensing of the web material. The second roller is positioned at a distance from the first roller. The distance between the rollers extends in a direction perpendicular to the width direction. The rollers are thus positioned such that the rotational axes are juxtaposed. The separation unit may also comprise more than two rollers, positioned at a distance from each other, wherein the distance between the rollers extends in a direction perpendicular to the width direction.

Each of said first and said second rollers is provided with a plurality of protrusion elements being spaced along said rotational axes and protruding radially perpendicular from said axes. Each of said protrusion elements has a maximum width in said width direction, a maximum radial extension from said rotational axes, an inner portion adjacent to said rotational axes, and an outer portion remote from said rotational axes. By "maximum width" is meant the maximal extension of the protrusion element in the width direction. By "maximum radial extension" is meant the distance from the rotational axis of the roller to the most remote point on the protrusion element in the radial direction being perpendicular to the width direction of the rotational axis.

The outer portions of the protrusion elements on said first roller are arranged in a staggered relationship with the outer portions of the protrusion elements on the second roller. In other words, the rollers and the protrusion elements are placed such that the protrusion elements on the first roller are positioned in between the protrusion elements on the second roller. Further, the outer portions of the protrusion elements on said first roller are partially overlapping with said outer portions of said protrusion elements on said second roller along an imaginary line extending in a width direction with a radial overlap length, whereby an undulating passage for a web material is formed between said rollers such that the shape of the passage for a web material formed between the protrusion elements is meandering along the imaginary line. For at least one of the rollers, the sum of the maximum widths within the overlap length of all protrusion elements on that roller is between 5-30%, preferably between 12-20% of the web width of that roller. By "maximum width within the overlap length" is meant the maximal extension of the protrusion element in the width direction within the overlap length. Thus, the surface of the web material being in contact with the protrusion elements is relatively small compared to the separation units of the prior art, which optimizes the pinch force acting on the web material and provides an accurate separation.

The overlap between the protrusion elements has a radial overlap length between 2-40 mm, preferably 2-20 mm, more preferably 3-12 mm, or most preferably between 4-10 mm. Surprisingly, it has been found that when the radial overlap length is in the range mentioned above, preformed lines of weakness are correctly and easily broken, thus allowing an accurate and smooth separation of the web material. Without wishing to be bound by a theory, the inventor believes that this effect is achieved due to the "wrinkling" of the web material in the passage. This wrinkling causes local tension in the web material, which causes the material to burst as the preformed lines of weakness pass through the undulating passage. It is worth noting that the pinch force exercised by the separation unit of the present invention is strong enough to break the preformed lines of weakness, and at the same time weak enough not to damage the web material. Such an optimization of the pinch force is achieved due to the unique geometry of the separation unit.

Thus, by using the separation unit according to the present invention, the risk that any given preformed line of weakness would break before that particular line of weakness has reached the separation unit is eliminated. At the same time, the separation unit according to the present invention facilitates the separation of the web material such that the force needed for separation of the web material is minimized.

The web material mentioned above may in the context of the present invention be tissue paper, such as facial tissue, toilet tissue or paper towels, or may be nonwoven material. As would be understood by the person skilled in the art, the pinch force needed for accurate separation of the web material may need to be altered depending on the type of the web material. In order to provide the separation unit according to the present invention being usable with different types of web material, the distance between the rotational axes of the first and second rollers may be adjustable, thus enabling the radial overlap length in the undulating passage to be variable. This feature of the separation unit makes it very flexible and adaptive.

The protrusion elements of the separation unit according to the present invention may be of any suitable shape, as far as the radial overlap length is within the range specified above. Thus, the protrusion elements may be in the form of disc elements, propeller-shaped elements, cylinder elements or the like. The cross-section in a radial plane of the protrusion elements may be rounded at the outer periphery of the protrusion element. The cross-section at the outer periphery of the protrusion element may also be rectangular, triangular, wavy or the like. The maximum radial extensions of said protrusion elements may be between 5-50 mm, preferably 5-30 mm, more preferably 10-20 mm, or most preferably 12-18 mm.

The protrusion elements may be made of any suitable material that provides friction between the outer portion of the protrusion element and the web material. Thus, the protrusion elements may be made of rubber or another elastomeric material.

The protrusion elements may be covered by a sleeve or ring of an elastomeric material encircling the outer periphery of each individual protrusion element. The elastomeric material may be glued, vulcanized or simply stretched around the outer portion of the protrusion element.

The maximum widths of said protrusion elements may be between 4-20 mm, preferably 5-10 mm, most preferably 6-8 mm. As mentioned above, the maximum width of each protrusion element is determined by the dimension of the widest part of the protrusion element. The width of the protrusion element may be same or different along the radial direction. Thus, if the width of the protrusion element is the same along the radial direction, the maximum width within the overlap length is equal to the maximum width of the protrusion element. On the other hand, if the width of the protrusion element is different along the radial direction, the maximum width within the overlap length may be smaller or greater than the maximum width of the protrusion element.

The maximum radial extensions of the protrusion elements may be equal to or greater than the maximum widths of said protrusion elements. The more the difference between the maximum radial extensions and the maximum widths of the protrusion elements, the greater the undulation amplitude of the passage formed between the protrusion elements. This, in turn, means that with increasing undulation amplitude the pinch force increases.

The separation unit according to the present invention may be formed such that the protrusion elements are formed integral with the rollers, or such that the protrusion elements are separate units attached to the roller.

The spacing of the protrusion elements may be the same along the width direction of the first and/or said second roller. Also, the spacing of the protrusion elements may vary along the width direction of the first and/or said second roller. For instance, one of said first and said second rollers may comprise at least a first, a second and a third protrusion element, wherein the spacing between said first and said second protrusion elements along the width direction of said first and/or said second roller differs from the spacing between said second and said third protrusion elements along the width direction of said first and/or said second roller. The protrusion elements may be sparsely arranged in the central portion of the rollers, and concentrated in the peripheral portions of the rollers. If such an arrangement is used, a wrinkleless portion of the web material in the central portion of the roller may be more suitable for gripping by the user when the web material is to be separated.

As mentioned above, the distance between the rotational axes of the first and second rollers may be adjustable, thus enabling the radial overlap length in the undulating passage to be variable. Thus, the rollers may be arranged such that the distance between the rollers is manually changed depending on the type of the web material. Another alternative is that the distance between the rollers is automatically adjustable to provide an optimal separation. Such an automatic adjustment may be enabled by using rollers arranged with a biasing means. The biasing means may be a spring suspension, or suspension acting by gravity. Biasing means facilitate pulling the material through the separation unit when the dispenser is being loaded with a web material. Also, biasing means provides a flexible separation unit enabling a smooth passage of parts of the web material having thickness greater than the web material itself. Such parts may for instance be joints between two bundles of the web material. The distance between said rotational axes of said first and said second rollers may be between 8-100 mm. As will be understood by the person skilled in the art, the distance between the rotational axes may be chosen such that an undulating passage providing an optimal pinch force is formed depending on the type of the web material.

The separation unit according to the present invention may comprise protrusion elements having the same maximum radial extensions and same maximum widths. In other words, all the protrusion elements may be equally sized. The separation unit according to the present invention may comprise protrusion elements having different maximum radial extensions and/or different maximum widths, i.e. the separation unit comprises protrusion elements of different sizes. Thus, a plurality of radial overlaps having different lengths will be formed for every given distance between the rotational axes. It has been found that the performance of the separation unit according to the present invention is improved when the spacing between each two protrusion elements is equal to or greater than the maximum width of each protrusion element. Such a relationship between the spacing between the protrusion elements and the maximum widths of the protrusion elements provides for a scarce distribution of the protrusion elements along the rotational axes, which optimizes the pinch force affecting the web material, and facilitates separation of the web material at the desired position.

The separation unit according to the present invention may comprise protrusion elements wherein the maximum radial extensions of the protrusion elements are equal to or greater than said maximum widths of said protrusion elements. This means that the protrusion elements may be relatively large and thin, which contributes to an optimal pinch force of the web material.

The separation unit according to the present invention may be placed in a dispenser. Such a dispenser may comprise a housing defining a web material reservoir, a dispensing opening, a control unit for determining a correct tension and path of the web material, and a separation unit according to the present invention. The dispenser may further comprise a web material contained inside the housing. The web material comprises preformed lines of weakness and may be Z-folded to form a stack, or being in the form of a roll.

A leading portion of the web material is configured to be supported in a dispensing path from the reservoir to the dispensing opening. The leading portion may extend upwardly from the top of the said stack of said web material, or from the peripheral or central part of the roll.

The preformed lines of weakness may be perforation lines formed by alternating bonds and slots and having the perforation strength between 20-80 N/m, preferably 30-45 N/m measured using SS-EN ISO 12625-4:2005. This perforation strength may for instance be achieved by using perforation lines wherein the total bond length/(the total bond length+total slot length) is between 4% and 10%. It is desired to form perforation lines which are strong enough to enable feeding of the web material, but which are also weak enough to enable separation of the sheets along the perforation lines using the separation unit of the present invention. In this context, it is known that also other parameters may influence the strength of the perforation line, such as the paper quality, and the size, shape and distribution of the slots and bonds. However, it is believed that the above-mentioned measure is useful for guiding the person skilled in the art when selecting suitable perforation lines.

The web material may be a two-layer structure, i.e. the web material may comprise at least a first web layer divided into sheet products defined between longitudinally separated preformed lines of weakness extending across the first layer; and at least a second web layer divided into sheet products defined between longitudinally separated lines of weakness extending across the second web layer. The web layers may be interfolded so that the lines of weakness of the first web layer are offset from the lines of weakness of the second web layer in a longitudinal direction.

Further, the dispenser may comprise a feeding mechanism, i.e. a motor to advance a web through the dispenser.

BRIEF DESCRIPTION OF THE DRAWINGS

Embodiments of the invention will now be described by way of example with reference to the accompanying drawings, of which.

DETAILED DESCRIPTION OF PREFERRED EMBODIMENTS

Figure 1A:
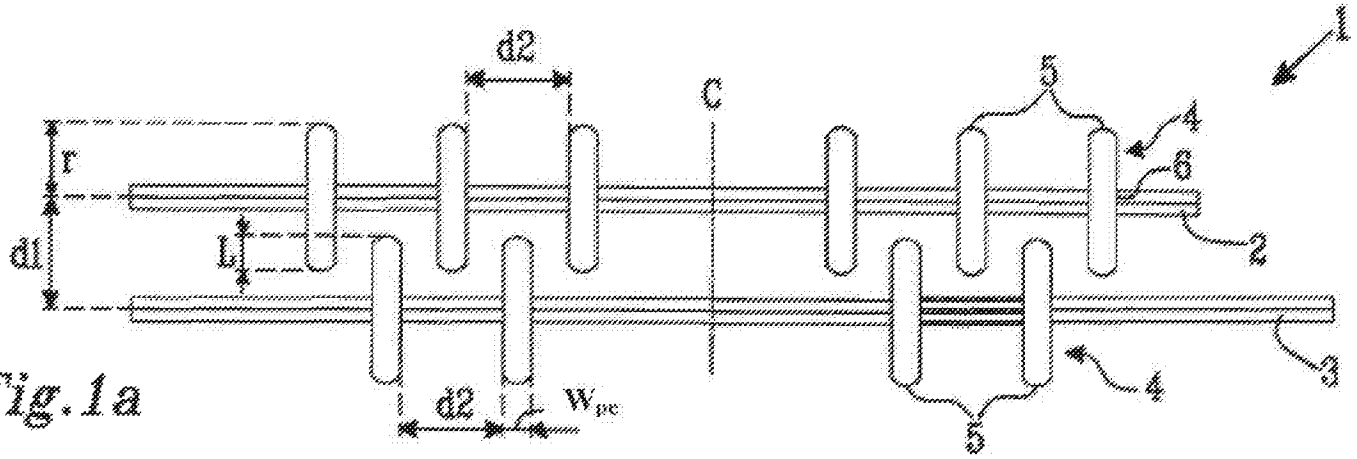
FIGS. 1*a*, 1*b* and 1*c* show a separation unit according to the present invention.
Figure 1B:
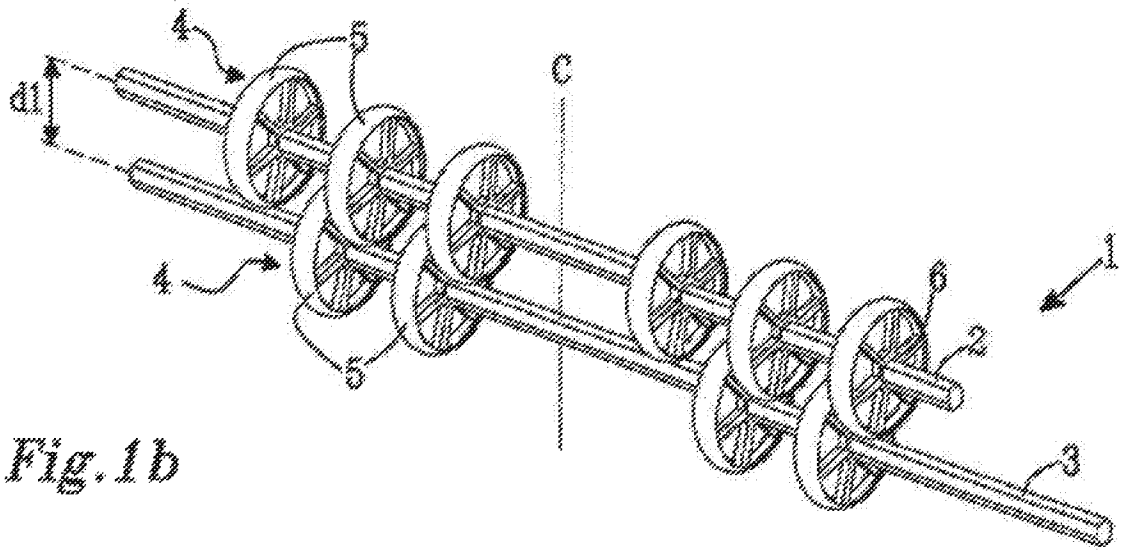
Figure 1C:
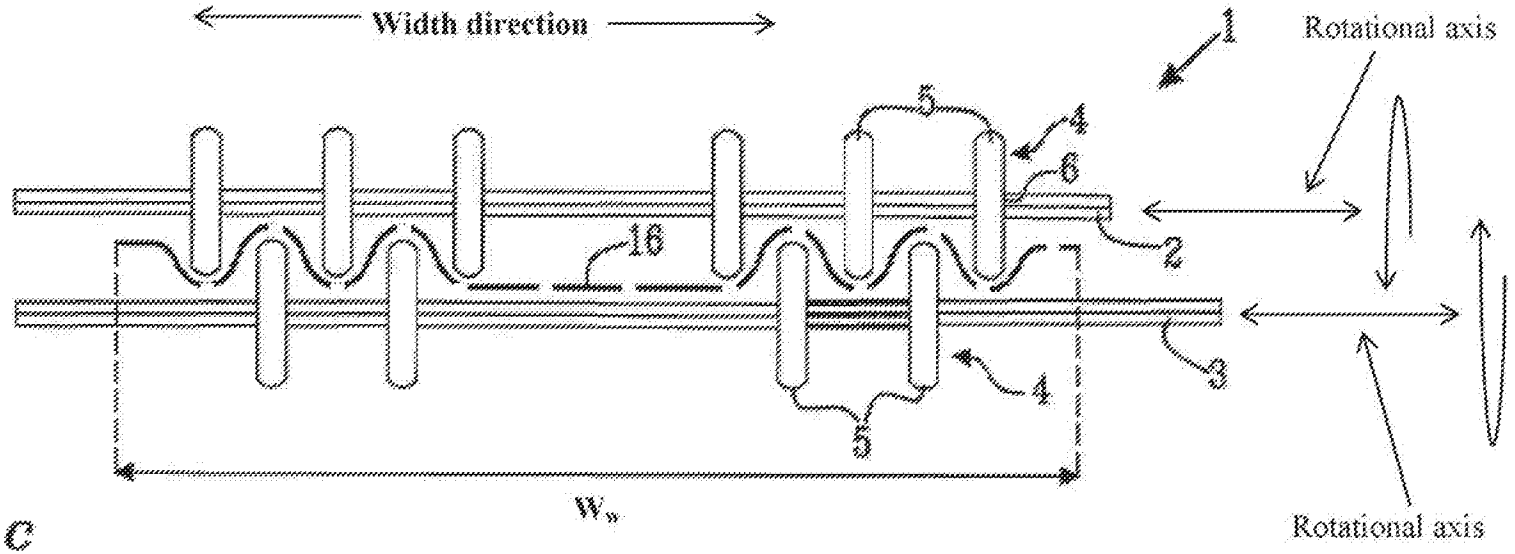
Figure 2:
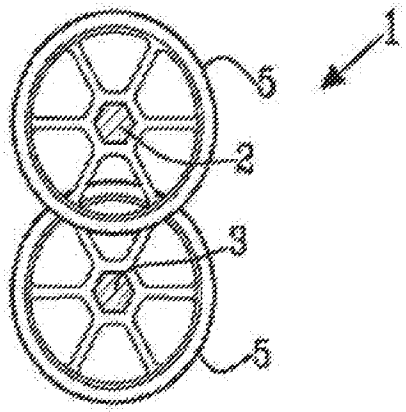
FIG. 2 shows the separation unit according to the present invention seen in the width direction.

FIGS. 1*a* and 1*b* show a separation unit 1 according to the present invention. The separation unit 1 comprises a first roller 2 and a second roller 3, each extending in a width direction and comprising plurality of protrusion elements 4 being spaced along the rollers 2, 3 and protruding perpendicular from the rollers 2, 3. The rollers 2, 3 are positioned at a distance $d_1$ from each other, wherein the distance $d_1$ is extending in a direction perpendicular to the width direction of the rollers 2, 3. In the embodiment shown in FIG. 1*a*, the first roller 2 comprises six protrusion elements 4, and the second roller 3 comprises four protrusion elements 4. The separation unit 1 has a web width $W_w$ (FIG. 1*c*). Each of the protrusion elements 4 has a maximum width $W_{pe}$ in the width direction and a maximum radial extension r from the rollers 2, 3. In the embodiment shown in FIG. 1*a*, the maximum widths $W_{pe}$ and the maximum radial extensions r of all the protrusion elements 4 are the same. Each protrusion element has an inner portion 6 adjacent to the rollers 2, 3, and an outer portion 5 remote from the rollers 2, 3, wherein the outer portions 5 of the protrusion elements 4 on the first roller 2 are arranged in a staggered relationship with the outer portions 5 of the protrusion elements 4 on the second roller 3, which is best seen in FIG. 2. The outer portions 5 of the protrusion elements 4 have a slightly curved shape. The outer portions 5 of the protrusion elements 4 on the first roller 2 are partially overlapping with the outer portions 5 of the protrusion elements 4 on the second roller 3 with a radial 15 overlap length L. Such a configuration of the protrusion elements forms an undulating passage for a web material between the rollers 2, 3 (FIG. 1*c*).

In the embodiment shown in FIGS. 1*a* and 1*b*, no protrusion elements are placed in the central portion C of the rollers 2, 3. Such an arrangement of the protrusion elements allows the user to easily access the leading end of the web material 16 in the central portion C of the separation unit 1 (FIG. 1*c*).

As may be seen in FIGS. 1*a* and 1*b*, the spacing $d_2$ between each two protrusion elements 4 is equal to or greater than the maximum width w of each protrusion element 4. Such a configuration enables the protrusion elements 4 to be relatively scarcely distributed, which provides an optimal pinch force.

Another advantageous feature of the separation unit according to the present invention is that the maximum radial extensions r of the protrusion elements are equal to or greater than the maximum widths $W_{pe}$ of the protrusion elements. As may be seen in FIGS. 1*a* and 1*b*, the protrusion elements are formed as relatively large and thin discs, which optimizes the pinch force.

FIG. 2 illustrates the separation unit 1 seen in the width direction. It is clearly shown that the outer portions 5 of the protrusion elements 4 on the first roller 2 overlap with the outer portions 5 of the protrusion elements 4 on the second roller 3.

Figure 3:
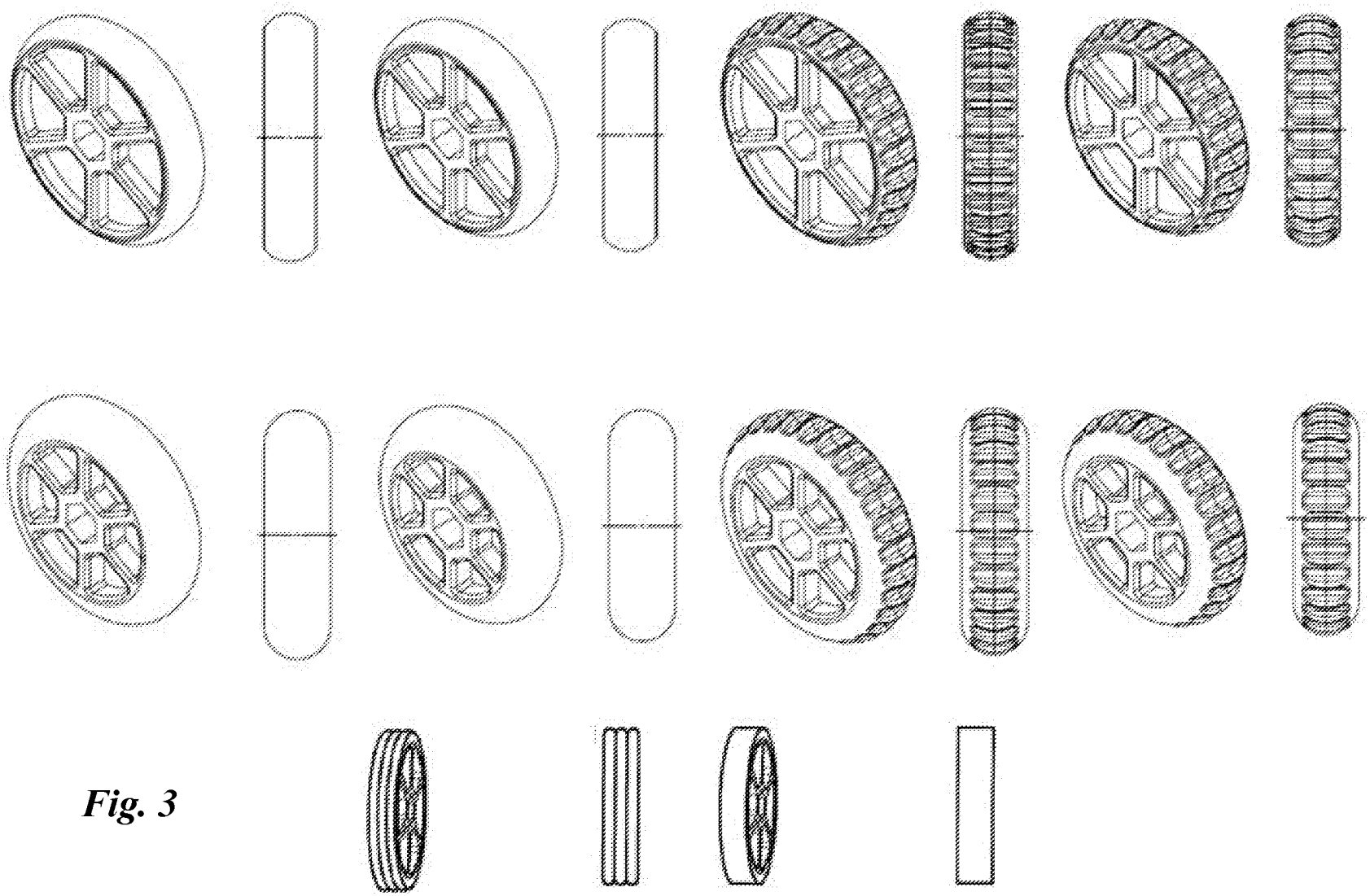
FIG. 3 shows protrusion elements having different dimensions and differently shaped outer portions.

As previously mentioned, the protrusion elements 4 may have different maximum widths $W_{pe}$ and maximum radial extension r. In FIG. 3, protrusion elements having different maximum widths $W_{pe}$ and different maximum radial extensions r are shown.

As mentioned above, the shape of the outer portions 5 of the protrusion elements 4 may vary. In FIG. 3, four other possible shapes of the outer portions 5 are depicted. Thus, the outer portions may have smooth surface, or may be provided with ribbed surface. As will be understood by the person skilled in the art, if the surfaces of the outer portions of the protrusion elements are ribbed, the friction between the web material and the outer surfaces of the protrusion elements, and thus the pinch force, is greater compared to the friction provided by smooth surfaces.

Figure 4:
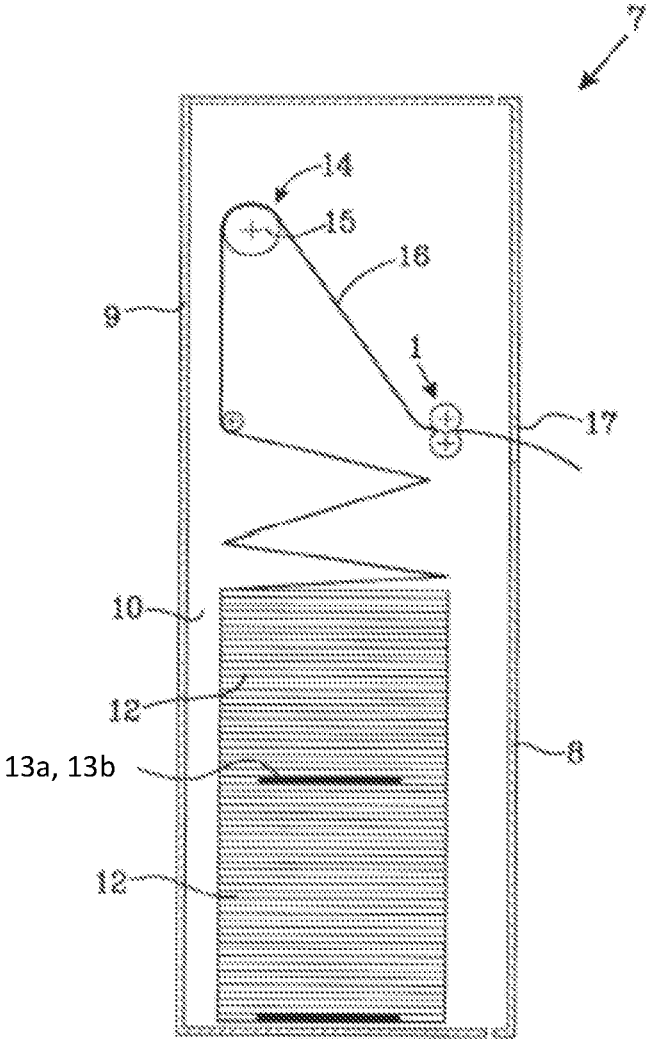
FIGS. 4 and 5 show a dispenser comprising the separation unit according to the present invention.

FIG. 4 schematically shows a dispenser 7 with a separation unit 1 according to the present invention. The dispenser 7 has an outer front wall 8, two outer side walls 9 and a housing 10. The housing 10 is intended for holding a pile of a continuous length of accordion-like folded web of towels of tissue paper or nonwoven comprising bundles 12 of a continuous length of accordion-like folded web of towels of tissue paper or nonwoven. The bundles 12 comprise connecting means 13*a*, 13*b* between the bundles 12. The dispenser 7 comprises a guiding element 14 in the form of a curved plate which extends over a segment of the web-supporting roller surface 15. The at least one web 16 is arranged to be fed through the guiding element 14 when the dispenser 7 is in use, and at least one part of the guiding element 14 is arranged to bear against the web 16. The guiding element 14 thereby holds the at least one web 16 in place on the roller surface 15 so that it does not move backwards or sidewards during the use of the dispenser, or in case of web-breakage.

The unit subsequent to the guiding element 14 is separation unit 1 described above. The separation unit 1 provides an optimal pinch force acting on the web material 16, and allows the web material 16 to be separated at the desired position. The separation unit 1 depicted in FIG. 4 is configured such that both of the rollers 2, 3 are positioned inside the housing 10. It is also conceivable that one of the rotational axes is located in the outer front wall 8, such that when the outer front wall 8 is opened, the pinch force caused by the separation unit 1 is released.

The dispenser 7 illustrated in FIG. 4 comprises a stack of interfolded webs 16, whereby the dispenser 7 is configured so that a preceding stack of interfolded webs in the housing 10 has to be lifted to position a new, succeeding stack in the housing 10 underneath the preceding stack to refill the dispenser 7. Stacks of interfolded webs in the dispenser 7 may be interconnected via connecting means 13*a*, 13*b*, such as adhesive, adhesive tape or mechanical fasteners, such as hook and loop fasteners, at the bottom and/or top of each of the refill stacks. The web 16 is arranged to be fed upwards within the housing 10, around the roller 15 located at the top of the dispenser 7 and downwards towards the separation unit 1 and the dispensing opening 17.

Figure 5:
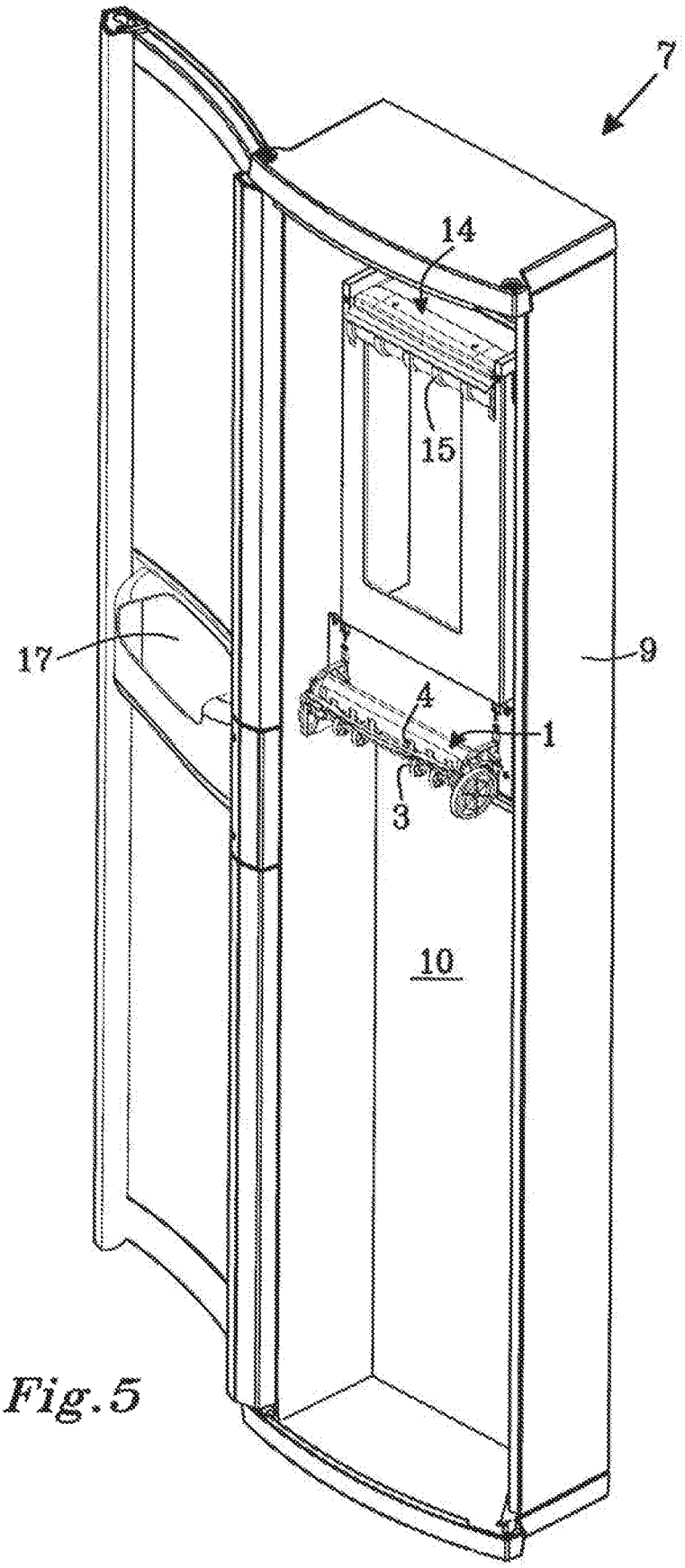

In FIG. 5 the dispenser 7 is depicted in the state when no web material 16 is loaded. The separation unit 1 is positioned within the housing 10 at the same level as the dispensing opening 17, such that the perforated web 16 is separated along the preformed lines of weakness at the moment of dispensing with almost no effort from the user's side.

It should be noted that the dispenser 7 according to the present invention may be any type of automatic or non-automatic dispenser for dispensing at least one web, i.e. a plurality of webs may be dispensed simultaneously, or a plurality of different webs may be dispensed by the dispenser 7 one at a time.

The dispenser 7 is a free-standing, but the dispenser may also be mounted on any suitable object in any suitable manner. Furthermore, a dispenser housing 10 of a dispenser according to the present invention need not necessarily contain an entire web 16 that is to be dispensed by the dispenser 7. At least one web 16 may for example be stored outside the housing 10 and merely be fed through the housing 10 when the dispenser 7 is in use.

Figure 6:
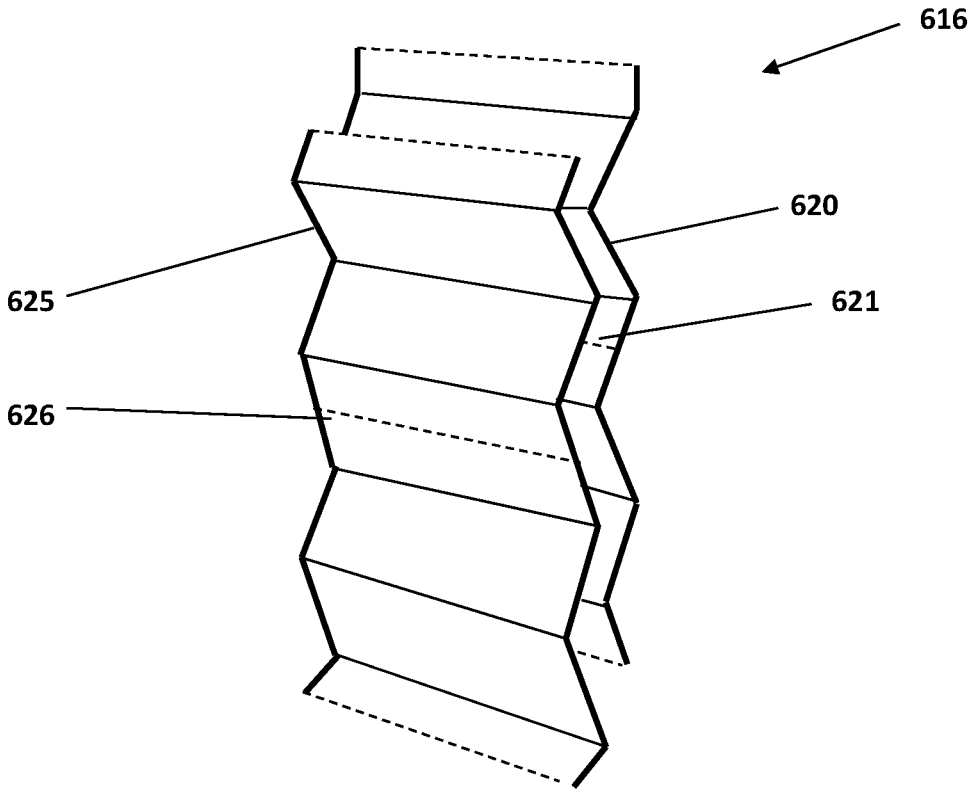
FIG. 6 shows a web material with a first web layer divided into sheet products defined between longitudinally separated preformed lines of weakness extending across the first layer and a second web layer divided into sheet products defined between longitudinally separated lines of weakness extending across the second web layer. The web layers are interfolded so that the lines of weakness of the first web layer are offset from the lines of weakness of the second web layer in a longitudinal direction.

FIG. 6 shows a web material 616 with a first web layer 620 divided into sheet products defined between longitudinally separated preformed lines of weakness 621 extending across the first layer 620; and at least a second web layer 625 divided into sheet products defined between longitudinally separated lines of weakness 626 extending across the second web layer 625. The web layers 620, 625 may be interfolded so that the lines of weakness 621 of the first web layer 620 are offset from the lines of weakness 626 of the second web layer 625 in a longitudinal direction.

Although the present invention has been described with reference to various embodiments, those skilled in the art will recognize that changes may be made without departing from the scope of the invention. It is intended that the detailed description be regarded as illustrative and that the appended claims including all the equivalents are intended to define the scope of the invention.

EMBODIMENTS

1. A separation unit for separating a web material along preformed lines of weakness, said separation unit having a width direction and comprising a first roller having a rotational axis extending in said width direction and a web width extending in said width direction, and a second roller having a rotational axis extending parallel with said rotational axis of said first roller and a web width extending in said width direction, said second roller being positioned at a distance from said first roller, said distance extending in a direction perpendicular to said width direction, wherein each of said first and said second rollers is provided with a plurality of protrusion elements being spaced along said rotational axes and protruding perpendicularly from said axes, wherein each of said protrusion elements has a maximum width in said width direction, a maximum radial extension from said rotational axes, an inner portion adjacent to said rotational axes, and an outer portion remote from said rotational axes, wherein said outer portions of said protrusion elements on said first roller are arranged in a staggered relationship with said outer portions of said protrusion elements on said second roller, and wherein said outer portions of said protrusion elements on said first roller are partially overlapping with said outer portions of said protrusion elements on said second roller with a radial overlap length, thus forming an undulating passage for a web material between said rollers, characterized in that each protrusion element has a maximum width along the width direction within the overlap length, and the sum of said maximum widths within the overlap length of all protrusion elements on one of said rollers is between 5-30%, preferably 12-20% of said web width of that roller.
2. The separation unit according to embodiment 1, wherein said protrusion elements have different maximum radial extensions and/or different maximum widths.
3. The separation unit according to embodiment 1, wherein said protrusion elements have same maximum radial extensions and same maximum widths.
4. The separation unit according to anyone of the preceding embodiments, wherein said spacing between each two protrusion elements is equal to or greater than said maximum width of each protrusion element.
5. The separation unit according to anyone of the preceding embodiments, wherein said maximum radial extensions of said protrusion elements are equal to or greater than said maximum widths of said protrusion elements.
6. The separation unit according to anyone of the preceding embodiments, wherein said maximum radial extensions of said protrusion elements are between 5-50 mm, preferably 5-30 mm, more preferably 10-20 mm, or most preferably 12-18 mm.
7. The separation unit according to anyone of the preceding embodiments, wherein the maximum widths of said protrusion elements are between 4-20 mm, preferably 5-10 mm, most preferably 6-8 mm.
8. The separation unit according to anyone of the preceding embodiments, wherein said protrusion elements are arranged with same spacing in different parts of said first and/or said second roller.
9. The separation unit according to embodiments 1-7, wherein at least one of said first and said second rollers comprises at least a first, a second and a third protrusion element, wherein the spacing between said first and said second protrusion elements along the width direction of said first and/or said second roller differs from the spacing between said second and said third protrusion elements along the width direction of said first and/or said second roller.
10. The separation unit according to embodiments 1-7, wherein each of said first and said second rollers has a central portion and outer portions in said width direction, and wherein said spacing between said protrusion elements is greater in said central portion than in said peripheral portions.
11. The separation unit according to anyone of the preceding embodiments, wherein said radial overlap length is between 2-40 mm, preferably 2-20 mm, more preferably 3-12 mm, or most preferably between 4-10 mm.
12. The separation unit according to anyone of the preceding embodiments, wherein said distance between said rotational axes of said first and said second rollers is between 8-100 mm.
13. The separation unit according to anyone of the preceding embodiments, wherein said protrusion elements are formed integral with said first and/or second roller.
14. The separation unit according to embodiments 1-13, wherein said protrusion elements are separate units attached to said first and/or second roller.
15. The separation unit according to anyone of the preceding embodiments, wherein said distance between said rotational axes of said first and said second rollers is adjustable.
16. The separation unit according to embodiment 15, wherein said adjustment is enabled by biasing means.
17. The separation unit according to anyone of the preceding embodiments, wherein said protrusion elements are disc elements.
18. The separation unit according to anyone of the preceding embodiments, wherein said outer portions of said protrusion elements have ribbed surfaces.
19. A dispenser for a web material, comprising
a housing defining a web material reservoir;
a dispensing opening;
a control unit;
a separation unit according to anyone of the embodiments 1-18.
20. The dispenser according to embodiment 19 for containing a web material comprising preformed lines of weakness, said web material being Z-folded to form a stack.
21. The dispenser according to embodiment 19 for containing a web material comprising preformed lines of weakness, said web material being in the form of a roll.

22. The dispenser according to anyone of embodiments 19-21, wherein the dispenser further comprises a feeding mechanism.

23. The dispenser according to anyone of embodiments 19-22, wherein said web material is contained in said reservoir, and wherein a leading portion of said web material is supported in a dispensing path from said reservoir to said dispensing opening.

24. The dispenser according to embodiment 23, wherein said leading portion extends upwardly from the top of the said stack of said web material.

25. The dispenser according to anyone of embodiments 19-24, wherein said preformed lines of weakness are perforation lines formed by alternating bonds and slots and having the perforation strength between 20-80 N/m, preferably 30-45 N/m.

26. The dispenser according to anyone of embodiments 19-25, wherein said web material comprises at least a first layer divided into sheet products defined between longitudinally separated lines of weakness extending across the first layer; and at least a second elongate web divided into sheet products defined between longitudinally separated lines of weakness extending across the second layer; wherein the webs are interfolded so that the lines of weakness of the first web are offset from the lines of weakness of the second web in a longitudinal direction of the first web.

The invention claimed is:

1. A method of loading a dispenser with a stack of a Z-folded web of paper having a plurality of longitudinally spaced preformed lines of weakness, the method comprising:

providing or obtaining a dispenser having a separation unit, wherein the separation unit comprises:

a first device having an axis extending in a width directions and a web width extending in said width direction, and a second device having an axis extending parallel with said axis of said first device, said second device being positioned at a distance from said first device, and a web width extending in said width direction, said distance extending in a direction perpendicular to said width direction, wherein each of said first and said second devices is provided with a plurality of protrusion elements being spaced along said axes and protruding perpendicularly from said axes, wherein each of said protrusion elements has a maximum width in said width direction, a maximum extension from said axes, an inner portion adjacent to said axes, and an outer portion remote from said axes, wherein said outer portions of said protrusion elements on said first device are arranged in a staggered relationship with said outer portions of said protrusion elements on said second device, and wherein said outer portions of said protrusion elements on said first device are partially overlapping with said outer portions of said protrusion elements on said second device with a overlap length, thus forming an undulating passage for a web material between said devices, wherein each protrusion element has a maximum width along the width direction within the overlap length, and the sum of said maximum widths within the overlap length of all protrusion elements on one of said devices is between 5-30% of said web width of that device, wherein the separation unit is configured to create a pinch force on the web material, wherein the separation of the web material along a preformed line of weakness comprises passage through the separation unit and the pinch force, and wherein the separation unit is configured to separate the web of paper along a preformed line of weakness with the pinch force;

inserting a bundle in the form of the stack of the Z-folded web of paper in pre-folded form through a bottom section of the dispenser, the dispenser comprising a plurality of walls defining a reservoir for holding one or more bundles of pre-folded Z-folded web, and a dispensing opening, the dispenser extending vertically along a longitudinal dimension and horizontally along a width dimension; and wherein said Z-folded web of paper comprises at least a first web divided into sheet products defined between longitudinally separated lines of weakness extending across the first web; and at least a second web divided into sheet products defined between longitudinally separated lines of weakness extending across the second web; wherein the webs are interfolded so that the lines of weakness of the first web are offset from the lines of weakness of the second web in a longitudinal direction of the first web, wherein a sheet product from only one web is configured to be dispensed at a time.

2. The method of claim 1, wherein the bundle is the first of at least two bundles of Z-folded web in the reservoir of the dispenser, and wherein each of the at least two bundles has a connector on an end face thereof configured to attach a respective bundle to an adjacent bundle, the method further comprising:

inserting a further bundle of Z-folded web in pre-folded form through the bottom section of the dispenser; and connecting the first bundle and the further bundle to one another by engaging the connector of the further bundle with the first bundle.

3. The method of claim 1, wherein the bundle is the first of at least two bundles of Z-folded web in pre-folded form in the reservoir of the dispenser, and wherein each of the at least two bundles has a connector on an end face thereof configured to attach a respective bundle to an adjacent bundle, the method further comprising:

inserting a further bundle of Z-folded web through the bottom section of the dispenser; and connecting the first bundle and the further bundle to one another by engaging the connector of the first bundle with the further bundle.

4. The method of claim 1, wherein the bundle is the first of at least two bundles of Z-folded web in pre-folded form in the reservoir of the dispenser, and wherein each of the at least two bundles has a connector on an end face thereof configured to attach a respective bundle to an adjacent bundle, the method further comprising:

inserting a further bundle of Z-folded web through the bottom section of the dispenser; and connecting the first bundle and the further bundle to one another by engaging the connector of the first bundle with the connector of the further bundle.

5. The method of claim 1, further comprising:

guiding a leading portion of the Z-folded web upwardly toward a support roller adjacent a top wall of the dispenser;

guiding the leading portion of the Z-folded web over the support roller and downward toward a separation unit of the dispenser comprising a first roller and a second roller, the first roller comprising a first plurality of discs spaced apart from one another, the second roller comprising a second plurality of discs spaced apart from one another, the first plurality of discs being offset in the width dimension with respect to the second plurality of discs, the first plurality of discs radially overlapping the second plurality of discs so as to define an undulatory path for the Z-folded web in the width dimension;

guiding the leading portion of the Z-folded web between the first plurality of discs and the second plurality of discs; and extending the leading portion of the Z-folded web through the dispensing opening toward an exterior of the dispenser, and wherein the leading portion of the Z-folded web extends across a width of the dispensing opening without folding in a longitudinal direction of the Z-folded web due to the width of the dispensing opening.

6. The method of claim 5, wherein guiding the leading portion of the Z-folded web between the first plurality of discs and the second plurality of discs includes guiding the leading portion of the Z-folded web between the first plurality of discs and the second plurality of discs having a radial overlap in the range of about 2 to about 40 mm.

7. The method of claim 5, further comprising exerting a pulling force on the leading portion of the Z-folded web through the dispensing opening, the pulling force being effective to separate an individual sheet of paper from a remainder of the Z-folded web.

8. The method of claim 1, wherein the separation unit is configured to create a pinch force on the web of paper.

9. The method of claim 1, wherein the separation unit is configured to separate the web of paper along a preformed line of weakness without a sideways force.

10. A method of refilling a dispenser with a pre-folded refill bundle in the form of a stack of a Z-folded web of paper having a plurality of longitudinally spaced preformed lines of weakness, the method comprising:

providing or obtaining a dispenser having a separation unit, wherein the separation unit comprises:

a first device having an axis extending in a width directions and a web width extending in said width direction, and a second device having an axis extending parallel with said axis of said first device, said second device being positioned at a distance from said first device, and a web width extending in said width direction, said distance extending in a direction perpendicular to said width direction, wherein each of said first and said second devices is provided with a plurality of protrusion elements being spaced along said axes and protruding perpendicularly from said axes, wherein each of said protrusion elements has a maximum width in said width direction, a maximum extension from said axes, an inner portion adjacent to said axes, and an outer portion remote from said axes, wherein said outer portions of said protrusion elements on said first device are arranged in a staggered relationship with said outer portions of said protrusion elements on said second device, and wherein said outer portions of said protrusion elements on said first device are partially overlapping with said outer portions of said protrusion elements on said second device with a overlap length, thus forming an undulating passage for a web material between said devices, wherein each protrusion element has a maximum width along the width direction within the overlap length, and the sum of said maximum widths within the overlap length of all protrusion elements on one of said devices is between 5-30% of said web width of that device, wherein the separation unit is configured to create a pinch force on the web material, wherein the separation of the web material along a preformed line of weakness comprises passage through the separation unit and the pinch force, and wherein the separation unit is configured to separate the web of paper along a preformed line of weakness with the pinch force;

inserting the refill bundle of the Z-folded web of paper through a bottom section of the dispenser comprising a plurality of walls defining a reservoir for holding one or more pre-folded bundles of Z-folded web, and a dispensing opening, the dispenser extending vertically along a longitudinal dimension and horizontally along a width dimension; and connecting the refill bundle of the Z-folded web of paper to an existing bundle of a Z- folded web of paper already in the reservoir, and wherein said Z-folded web of paper comprises at least a first web divided into sheet products defined between longitudinally separated lines of weakness extending across the first web; and at least a second web divided into sheet products defined between longitudinally separated lines of weakness extending across the second web; wherein the webs are interfolded so that the lines of weakness of the first web are offset from the lines of weakness of the second web in a longitudinal direction of the first web, wherein a sheet product from only one web is configured to be dispensed at a time.

11. The method of claim 10, wherein the radial overlap length is about 2 to about 40 mm.

12. The method of claim 10, wherein the first bundle and the refill bundle each have a connector on an end face thereof configured to attach a respective bundle to an adjacent bundle, the method comprising:

connecting the refill bundle and the existing bundle to one another by engaging the connector of the existing bundle with the refill bundle.

13. The method of claim 10, wherein the first bundle and the refill bundle each have a connector on an end face thereof configured to attach a respective bundle to an adjacent bundle, the method comprising:

connecting the refill bundle and the existing bundle to one another by engaging the connector of the refill bundle with the connector of the existing bundle.

14. The method of claim 10, wherein the first bundle and the refill bundle each have a connector on an end face thereof configured to attach a respective bundle to an adjacent bundle, the method comprising:

connecting the refill bundle and the existing bundle to one another by engaging the connector of the refill bundle with the existing bundle.

15. The method of claim 10, wherein the existing bundle has:

a portion guided upwardly over a support roller adjacent a top wall of the dispenser and downward to a separation unit of the dispenser comprising a first roller and a second roller, the first roller comprising a first plurality of discs spaced apart from one another, the second roller comprising a second plurality of discs spaced apart from one another, the first plurality of discs being offset in the width dimension with respect to the second plurality of discs, the first plurality of discs radially overlapping the second plurality of discs, the portion being guided between the first plurality of discs and the second plurality of discs so that the portion has an undulatory path in the width dimension, and extended through the dispensing opening toward an exterior of the dispenser, wherein, upon connecting, a leading portion of the refill bundle is configured to be:

guided upwardly toward the support roller adjacent the top wall of the dispenser;

guided over the support roller and downward toward the separation unit of the dispenser;

guided between the first plurality of discs and the second plurality of discs to thereby cause the first roller and the second roller to rotate; and extended through the dispensing opening toward an exterior of the dispenser, wherein the leading portion of the Z-folded web is configured to be extended across a width of the dispensing opening without folding in a longitudinal direction of the Z-folded web due to the width of the dispensing opening.

16. The method of claim 10, wherein the separation unit is configured to separate the web of paper along a preformed line of weakness without a sideways force.

17. The method of claim 10, wherein the separation unit is configured to create a pinch force on the web of paper.

* * * * *